US005509816A

United States Patent [19]

Katsuma

[11] Patent Number: 5,509,816

[45] Date of Patent: Apr. 23, 1996

[54] LEVER-TYPE CONNECTOR AND METHOD FOR ASSEMBLING AND CONNECTING SAME

[75] Inventor: Takatoshi Katsuma, Yokkaichi, Japan

[73] Assignee: Sumitomo Wiring Systems Ltd., Mie, Japan

[21] Appl. No.: 255,918

[22] Filed: Jun. 7, 1994

[51] Int. Cl.[6] ..... H01R 13/62

[52] U.S. Cl. ..... 439/157; 439/153

[58] Field of Search ..... 439/152–160, 439/372

[56] References Cited

U.S. PATENT DOCUMENTS

| | | | |
|---|---|---|---|
| 5,257,942 | 11/1993 | Taguchi | 439/153 |
| 5,320,544 | 6/1994 | Naoto et al. | 439/157 |
| 5,330,362 | 7/1994 | Ito et al. | 439/157 |
| 5,330,411 | 7/1994 | Fujitani et al. | 439/157 |
| 5,368,492 | 11/1994 | Hayashi | 439/157 |

FOREIGN PATENT DOCUMENTS 2179506 3/1987 United Kingdom .

*Primary Examiner*—David L. Pirlot
*Attorney, Agent, or Firm*—Oliff & Berridge

[57] ABSTRACT

Symmetrical communication portions formed in respective inner surfaces of arms of a lever extend from an inner end surface of a guide groove to an inner peripheral surface of a rotation hole. To connect the lever to the selected housing, the lever is moved parallel relative to the male housing in such a manner that rotation pins move along the respective guide grooves and communication portions until they are rotatably received in the respective rotation holes. Accordingly, there is no need to elastically deform the lever in order to attach the lever to the housing, and therefore, the burden on the operator is small because the two rotation pins are simultaneously guided to the respective rotation holes by the respective guide grooves. Therefore the attaching operation can be carried out easily and positively. After the lever is attached to the selected housing, another housing may be connected to the selected housing also using the communication portions of the lever.

12 Claims, 3 Drawing Sheets

LEVER-TYPE CONNECTOR AND METHOD FOR ASSEMBLING AND CONNECTING SAME

BACKGROUND OF THE INVENTION

This invention relates to a lever-type connector and a method for assembling and connecting a connector in which, for example, in the installation of a wire harness in an automobile, a housing having male terminals is connected to a housing having female terminals by a lever mounted on one of the two housings.

In the installation of a wire harness in an automobile, a lever-type connector is used for connecting a housing having male terminals to a housing having female terminals. In such a connector, a rotation hole is formed in an inner surface of each of two opposed arms of a U-shaped lever. Also, a guide groove of a generally volute shape is formed in the inner surface of each arm and is open to a distal end surface of the arm. A rotation pin is formed on each of opposite outer side surfaces of one of the two housings, the respective rotation holes in the lever are rotatably fitted on these rotation pins and a guide pin is formed on each of opposite outer side surfaces of the other housing.

In such a lever-type connector, the two housings are initially moved toward each other, and the guide pins on the other housing are received respectively in the guide grooves in the lever. Then, the other housing is moved toward the one housing through leverage produced by the engagement of the guide pins in the respective guide grooves upon rotation of the lever about the rotation pins. Finally, the two housings are connected to connect the male terminals to the female terminals. Thus, the connecting operation is carried out according to this procedure.

Conventionally, in such a lever-type connector, for attaching the lever to the housing, the lever is elastically deformed or expanded to move the two arms away from each other. In this condition the rotation pin is fitted in the rotation hole in one of the two arms, and thereafter, the lever is further deformed so as to be expanded. In this condition, the other rotation pin is fitted in the rotation hole in the other arm.

This method, however, has a drawback because the operator is required to produce a large force required for deforming or expanding the lever. In addition, because the rotation hole and the rotation pin are concealed inside the arm during the attaching operation, the operator cannot confirm the positions of the rotation hole with respect to the rotation pin using his or her eyes. This has resulted in a drawback that much time and labor are required for the attaching operation, thus adversely affecting the efficiency of the operation.

SUMMARY OF THE INVENTION

It is therefore an object of the present invention to provide a lever-type connector in which the attaching operation can be carried out in a time efficient manner.

It is another object of the present invention to provide a method for assembling a lever-type connector that does not require elastic deformation of the arm portions of the lever.

In accordance with a first aspect of the present invention, there is provided a lever-type connector having a U-shape and a guide groove of a generally volute shape formed in each of opposed inner surfaces of opposite end portions of the lever, the guide groove being open at its one end to a side surface of the end portion; each of the opposite end portions has a rotation hole open to the inner surface, the lever is attached to a housing having rotation pins formed respectively on opposite side surfaces thereof for rotatably fitting respectively in the rotation holes; and an inner end of each of the guide grooves is communicated with a peripheral surface of a respective one of the rotation holes.

In accordance with another aspect of the present invention, there is provided a connector comprising a first housing, a second housing and a lever connected to either the first or the second housing. The lever has a main body spanning the width of the selected housing and an arm attached at each end of the main body. Each arm includes one of a through and a blind hole for receiving a rotation pin attached to the selected housing to pivotably mount the lever on the rotation pin and a stepped groove having an introduction portion adjacent a distal end of the arm and a fitting guide portion of a volute shape arranged about the blind or through hole and disposed closer to the proximal end of the arm than the introduction portion.

In accordance with yet another aspect of the present invention, there is provided a connector including a housing and a lever with a main body and a pair of generally parallel extending arms having apertures attachable to rotation pins mounted on the housing. Each of the arms includes a proximal end connected to the main body and a distal end having a groove in communication with the aperture.

In accordance with still another aspect of the present invention, there is provided a method for assembling a lever-type connector having a first housing and a lever including a pair of arms having apertures attachable to pivot pins located on the first housing and grooves communicating the apertures to distal ends of the arms. The method includes the steps of aligning the distal ends with the pivot pins and sliding the pivot pins along the respective grooves until each of the pivot pins align with a respective one of the apertures.

For attaching the lever to the housing, the lever is moved parallel toward the housing, and the rotation pins of the housing are fitted respectively in the open end portions of the two guide grooves. Then, the lever is further moved parallel so that each rotation pin moves along a respective one of the guide grooves toward the inner end thereof and reaches a communication portion between the guide groove and the rotation hole. Finally, the rotation pin further moves to the rotation hole through the communication portion. When the rotation pins thus reach the rotation holes, respectively, the attachment of the lever is completed.

As described in connection with the above operation, in the present invention, there is no need to elastically deform the lever when attaching the lever to the housing. Moreover, the two rotation pins are simultaneously guided respectively to the rotation holes by the respective guide grooves. Therefore, the present inventive lever-type connector has the advantages that the attaching operation can be carried out easily and positively.

BRIEF DESCRIPTION OF THE DRAWINGS

The present invention will be described with reference to the following drawings wherein.

DETAILED DESCRIPTION OF PREFERRED EMBODIMENTS

Figure 1:
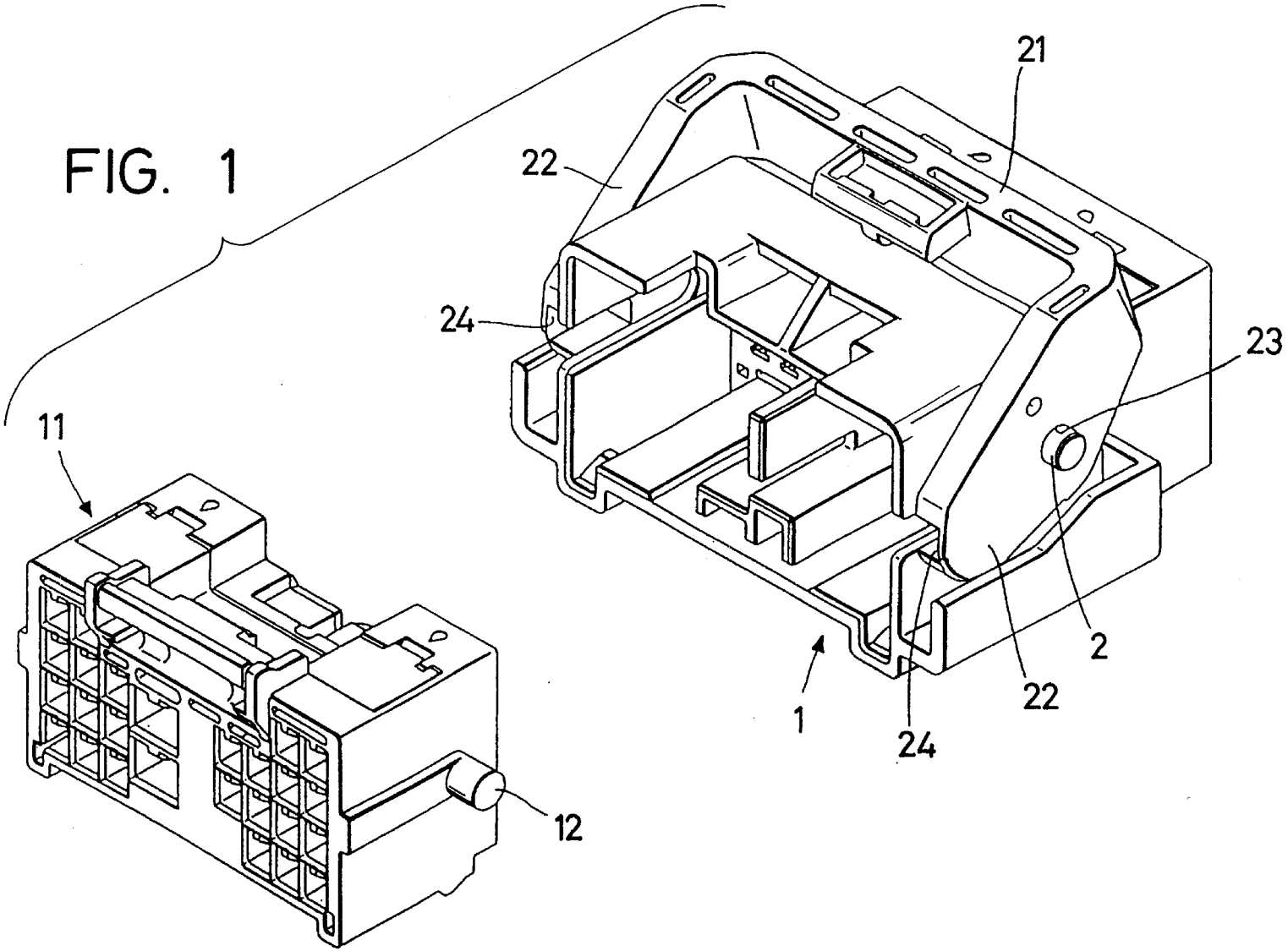
FIG. 1 is a perspective view showing a male connector housing and a female connector housing separated from each other.
Figure 2:
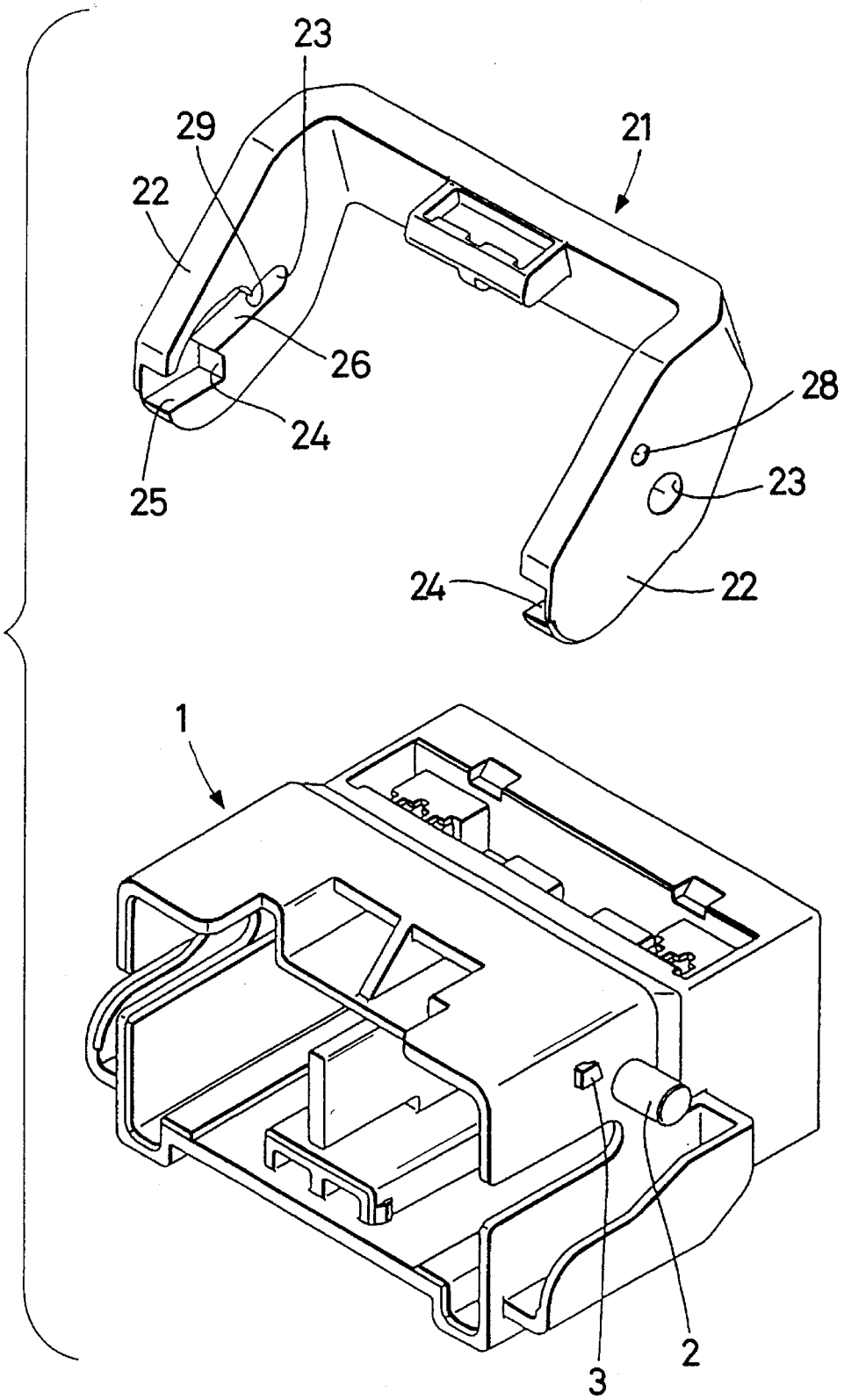
FIG. 2 is a perspective view showing a lever and the male connector housing separated from each other.
Figure 3:
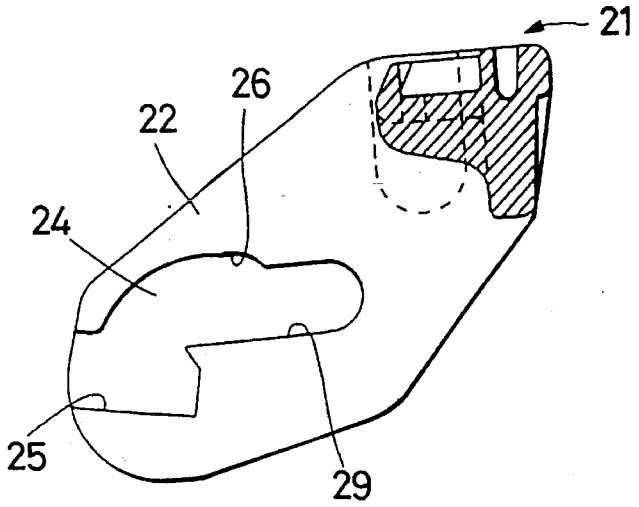
FIG. 3 is a cross-sectional view of the lever.
Figure 4:
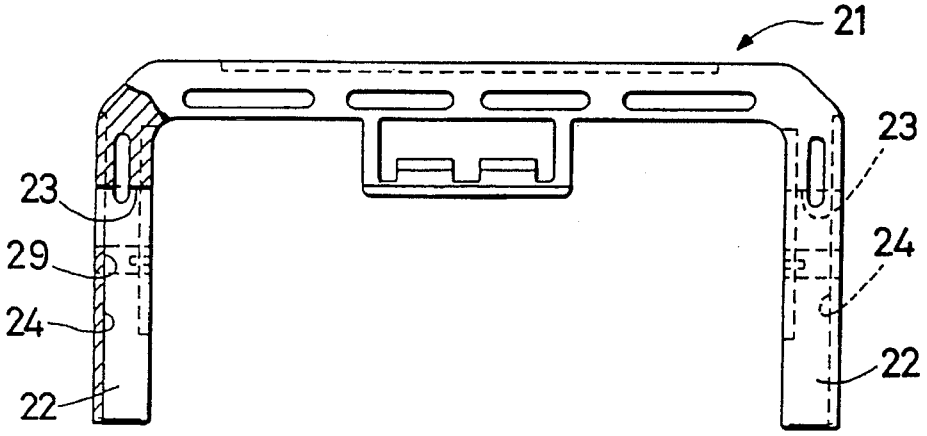
FIG. 4 is a partly-broken, plan view of the lever.

A male housing 1 is of a box-shape and has an open front side. A plurality of male terminals (not shown) are mounted within the male housing and are arranged to face the front side of this housing. Coaxially disposed rotation pins 2 for supporting a generally U-Shaped lever 21 of the type having a main body and a pair of depending arms 22, described later, are formed respectively on opposite outer side surfaces of the male housing 1.

A female housing 11 is of a box-shape and has such a size and configuration as to be fitted in the opening in the front portion of the male housing 1. A plurality of female terminals (not shown) are mounted within the female housing and are arranged to face the front side of the housing 1. When the male and female housings 1 and 11 are connected together, the male terminals are electrically connected to the female terminals, respectively. Guide pins 12 are formed respectively on opposite outer side surfaces of the female housing 11 and are disposed coaxially with each other. The guide pins 12 cooperate with the lever 21 to provide guide means for guiding the connection of the male housing 1 to the female housing 11.

The lever 21 has a general U-shape as a whole and has parallel extending arms 22 formed respectively at opposite sides thereof. Coaxially disposed rotation holes 23 are formed respectively through the two arms 22 of the lever 21 from their inside to outside.

The lever 21 is attached to the male housing 1 by means described later in such a manner that the rotation holes 23 rotatably fit on the respective rotation pins 2. Guide grooves 24 are formed respectively in inner surfaces of the two arms 22 of the lever 21 and are disposed symmetrically right and left, each of the guide grooves 24 being open to an outer surface of a distal end of the arm 22 and extending toward the rotation hole 23. The guide groove 24 has a straight introduction portion 25 adjacent the distal open end of the arm and a fitting guide portion 26 disposed closer to the proximal end of the arm than the introduction portion 25, the fitting guide portion 26 having a generally volute-shape arranged about the rotation hole 23. The width of the guide groove 24 is equal to or larger than the inner diameter of the rotation hole 23.

For connecting the male housing 1 to the female housing 11, the lever 21 is first attached to the male housing 1, and the male and female housings 1 and 11 are opposed to each other at their front faces. Then, the housings are moved toward each other to fit the guide pins 12 on the female housing 11 into the introduction portions 25 of the guide grooves 24 of the lever 21, respectively. Then, the lever 21 is rotated about the rotation pins 2 to bring the guide pins 12 respectively into the fitting guide portions 26 of the guide grooves 24. The lever 21 is further rotated to bring the guide pins 12 into sliding contact with the volute inner peripheral surfaces of the fitting guide portions 26, respectively, so that the two housings 1 and 11 are forcibly moved closer to each other through leverage. Finally the two housings 1 and 11 are connected together, thus completing the connecting operation according to this procedure.

Figure 5:
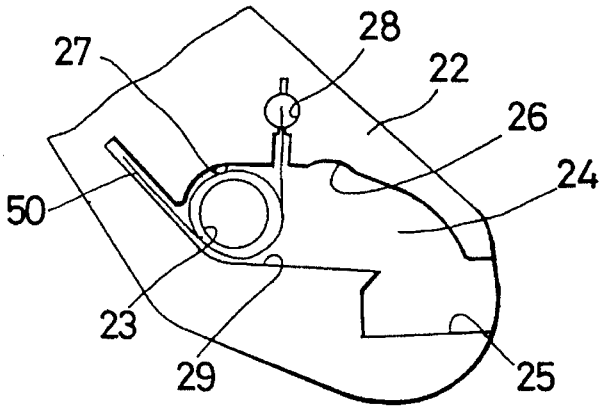
FIG. 5 is an enlarged, side-elevational view of a portion of one arm of the lever, as viewed from the inner side of the arm.

A torsion coil spring 50 for preventing free movement of the lever 21 is provided between the lever 21 and the male housing 1. For attaching the torsion coil spring to the housing 1, the spring is received in a mounting groove 27 (see FIG. 5) located in the inner surface of one of the arms 22 of the lever 21 before the lever 21 is attached to the male housing 1. After the lever 21 is attached to the male housing 1, in order to activate the torsion coil spring, one end portion of the torsion coil spring is urged towards the male housing 1 from the outside of the arm 22 through an operating hole 28 and is retained on a retaining portion 3 on the male housing 1.

Next, the means for attaching the lever 21 to the male housing 1 will be described.

Communication portions 29 are formed respectively in the inner surfaces of each arm 22 of the lever 21 and are disposed symmetrically right and left, each communication portion 29 extending from the inner end surface of the fitting guide portion 26 to the inner peripheral surface of the rotation hole 23. The communication portion 29 has such a width as to allow the rotation pin 2 of the male housing 1 to pass therethrough.

The provision of the communication portions 29 allows for the easy attachment of the lever 21 to the male housing 1 to be carried out in the following manner. Namely, the distal end of each arm 22 of the lever 21 is brought close to the respective rotation pins 2, and the introduction portions 25 of the right and left guide grooves 24 are fitted on the right and left rotation pins 2, respectively. The lever 21 is moved parallel relative to the male housing 1 in such a manner that the rotation pins 2 move along the guide grooves 24, respectively. As a result, the two rotation pins 2 pass from the introduction portions 25 of the guide grooves 24 to the communication portions 29 through the fitting guide portions 26 and finally reach the rotation holes 23 at which point they are rotatably fitted in these rotation holes, respectively. Thus, the attachment of the lever 21 to the male housing 1 is completed.

Thus, for attaching the lever 21, the operator does not need to use a large force for elastically deforming the lever, and therefore, the burden on the operator is reduced. In addition, the two rotation pins 2 are simultaneously guided by the guide grooves 24 to the rotation holes 23, respectively, and therefore, much less time and labor are required for the attaching operation so that the operation can be carried out easily and positively.

While the invention has been described in detail with reference to preferred embodiments thereof, which are intended to be illustrative but not limiting, various changes may be made without departing from the spirit and scope of the invention, which is defined in the following claims. For example, although the rotation hole 23 is formed through the arm 22 as a through-hole, it may also be manufactured as a blind hole that is formed in the inner surface of the arm and is not open to the outer surface of the arm. Furthermore, although the lever 21 is mounted on the male housing 1, the lever may be mounted on the female housing.

What is claimed is:

1. A lever-type connector comprising a generally U-shaped lever having a guide groove of a generally volute shape formed in each of opposed inner surfaces of opposite end portions of said lever, said guide groove being open at one end to a side surface of said end portion, each of said opposite end portions having a rotation hole open to said inner surface, said lever being attached to a housing of said connector having rotation pins formed on respective opposite side surfaces thereof for rotatably fitting respectively in said rotation holes, and an inner end of each of said guide grooves being contiguous with a peripheral surface of a respective one of said rotation holes.

2. A connector comprising:

a first housing having one of a plurality of male and female terminals and one of a pair of rotation pins and a pair of guide pins;

a second housing having the other of the plurality male and female terminals and the other of the rotation pins and the guide pins; and a lever connected to one of the first housing and the second housing, the lever having a main body spanning the width of the one housing and an arm attached at each end of the main body, each arm including:

one of a through hole and a blind hole for receiving a respective one of the rotation pins to pivotably mount the lever on the rotation pins of the selected housing; and a stepped groove having an introduction portion adjacent a distal end of the arm and a fitting guide portion of a volute shape arranged about said one of the through hole and the blind hole and disposed closer to a proximal end of the arm than the introduction portion.

3. The connector of claim 2, wherein the lever is pivotable between a first and a second position and wherein each guide pin is positioned in a respective introduction portion when the lever is located in said first position, and each guide pin is engaged with its respective fitting guide portion when the lever is pivoted to said second position.

4. The connector of claim 2, wherein a selected one of the arms further includes a torsion coil spring mounted within a mounting groove, a first end of the spring being anchored in the selected arm and a second end of the spring being anchored on a retaining portion coupled to said one housing.

5. The connector of claim 4, wherein said selected arm further includes an operating through hole, said second end of the torsion spring being accessible through said operating through hole.

6. A connector comprising a housing and a lever that includes a main body and a pair of generally parallel extending arms each having an aperture, said lever being attachable via said apertures to rotation pins mounted on said housing, each of said arms including a proximal end connected to the main body, a distal end, and a groove in communication with a respective one of the apertures and extending from said distal end to said proximal end.

7. The connector of claim 6, wherein each groove is a stepped groove having an introduction portion adjacent said distal end and a fitting guide portion adjacent said aperture, said fitting guide portion located between and contiguous with the introduction portion and the aperture.

8. The connector of claim 6, wherein a selected one of said arms includes a spring positioned within a mounting groove surrounding said aperture, one end of the spring being mountable in the selected arm and the other end of the spring being accessible through an operating hole in said selected arm and mountable on a retaining portion coupled to said housing.

9. A method for assembling a lever-type connector having a first housing and a lever including a pair of arms each having an aperture, said lever being attachable via said apertures to pivot pins located on said first housing, said arms further comprising grooves extending from respective distal ends of said arms to said apertures, the apertures being positioned at proximal ends of the pair of arms, the method comprising:

aligning the distal ends of the arms with the pivot pins; and sliding the pivot pins along the respective grooves from said distal ends towards said proximal ends of the arms until each of the pivot pins engages a respective one of said apertures.

10. The method of claim 9, further comprising:

providing a selected one of the arms with a torsion spring prior to the attaching step; and after the attaching step, shifting one end of the spring from the selected arm to a retaining portion coupled to the first housing while maintaining another end of the spring in engagement with the selected arm.

11. The method of claim 9, wherein each groove includes an introduction portion and a fitting guide portion, the method further comprising:

sliding guide pins of a second housing along the introduction passage; and pivoting the lever to a closed position thereby moving the guide pins from said introduction passage to said fitting guide portion and tightly connecting said first and second housings.

12. The method of claim 9, wherein each groove comprises an introduction portion located at the distal end of the arm and a fitting guide portion located to surround the aperture, the sliding step including sliding each pivot pin along the introducing portion and the fitting guide portion and lodging the pivot pin into engagement with the aperture.

* * * * *